US008033489B2

(12) United States Patent
Boast

(10) Patent No.: US 8,033,489 B2
(45) Date of Patent: Oct. 11, 2011

(54) IMPACT CRUSHER

(75) Inventor: Ian Boast, Staffs (GB)

(73) Assignee: Terex Pegson Limited, Leicestershire (GB)

( * ) Notice: Subject to any disclaimer, the term of this patent is extended or adjusted under 35 U.S.C. 154(b) by 50 days.

(21) Appl. No.: 12/325,534

(22) Filed: Dec. 1, 2008

(65) Prior Publication Data

US 2009/0140089 A1 Jun. 4, 2009

(30) Foreign Application Priority Data

Nov. 30, 2007 (GB) ..... 0723505.4

(51) Int. Cl.
*B02C 13/09* (2006.01)

(52) U.S. Cl. ..... 241/189.1; 241/286; 241/290

(58) Field of Classification Search ..... 241/189.1, 241/285.3, 286–290
See application file for complete search history.

(56) References Cited

U.S. PATENT DOCUMENTS

| | | | | |
|---|---|---|---|---|
| 3,637,145 | A | 1/1972 | Williams | |
| 3,873,035 | A | 3/1975 | Benson | |
| 5,226,604 | A | 7/1993 | Seiffert et al. | |
| 5,255,869 | A | 10/1993 | Smith | |
| 6,745,966 | B2 | 6/2004 | Heukamp | |
| 7,293,725 | B2 * | 11/2007 | Moriya et al. | 241/37 |
| 2007/0001043 | A1 * | 1/2007 | Moriya et al. | 241/189.1 |

FOREIGN PATENT DOCUMENTS

| | | | |
|---|---|---|---|
| DE | 1607456 | A1 | 12/1969 |
| GB | 1485712 | A | 9/1977 |
| GB | 1526890 | A | 10/1978 |
| GB | 2026896 | A | 2/1980 |
| GB | 2179565 | A | 3/1987 |

* cited by examiner

*Primary Examiner* — Faye Francis
(74) *Attorney, Agent, or Firm* — Gifford, Krass, Sprinkle, Anderson & Citkowski, P.C.

(57) ABSTRACT

An impact crusher includes a crushing chamber, a rotor mounted in the crushing chamber, and an apron having an impact surface, said apron being movably positioned within the chamber. The apron is pre-loaded to oppose forces generated within the crushing chamber. The apron is free to move away from the rotor in the event that the forces generated within the chamber exceed a predetermined threshold. During normal use, the apron is suspended within the chamber against a mechanical stop, and the apron is free to return to its initial suspended position after the removal of uncrushable material from the chamber.

8 Claims, 2 Drawing Sheets

IMPACT CRUSHER

CROSS-REFERENCE TO RELATED APPLICATIONS

This application claims the benefit of GB0723505.4, filed Nov. 30, 2007, which is incorporated herein by reference.

FIELD OF THE INVENTION

The present invention relates to impact crushers.

BACKGROUND OF THE INVENTION

Conventional impact crushers include a crushing chamber and a rotor mounted for rotation in the crushing chamber, the rotor being configured for striking feed material present in the crushing chamber. The rotor typically includes a plurality of arms, often referred to as 'hammers' or 'blow bars', which serve as primary impact devices for breaking down feed material in the crushing chamber.

Known impact crushers include a body within the crushing chamber, often referred to as an 'apron' or 'anvil', having an impact surface against which material present within the chamber may be comminuted during operation of the rotor. The impact surface of the apron may be arranged at a predetermined distance from the swept area of the rotor, in order to control the maximum grade of material that can pass through the crushing chamber.

An example of a known impact crusher of the kind set forth above is shown in U.S. Pat. No. 6,745,966, in which aprons are pivotably mounted within the crushing chamber. Each apron is coupled to an hydraulic cylinder or threaded spindle arrangement, which is used to set the spacing between the impact surface of the apron and the swept area of the rotor.

It will be understood that the apron is subjected to forces during comminution of material against its impact surface. Typically, the apron may be spring-loaded to provide a reaction against said forces. However, uncrushable oversize material in the crushing chamber may result in the generation of forces which exceed the spring-load, causing the apron to move away from the rotor, until said material has passed beyond the apron. The spring-load will then return the apron to its normal working position.

In a known crusher, the working position of the apron relative to the rotor is set using an hydraulic cylinder arrangement. This arrangement is also used to reset the working position of the apron, after passage of an uncrushable object, wherein a proximity sensor is used to detect when the apron has reached the desired working position.

SUMMARY OF THE INVENTION

It is an object of the invention to provide an impact crusher which improves upon the known crushers referred to above.

According to one aspect of the invention, there is provided an impact crusher including a crushing chamber, a rotor mounted in the crushing chamber, and an apron pivotably mounted in the crushing chamber, the apron having an impact surface to be positioned at a desired distance from the rotor, wherein the apron is coupled to a first arrangement for applying pre-load to the apron to oppose forces generated within the chamber during normal use, and wherein the apron is further coupled to a second arrangement for providing a mechanical stop against which the apron is suspended in normal use.

The pre-load is preferably selected to provide a desired pressure for comminution of feed material against the apron during operation of the rotor, wherein the apron is held substantially at a fixed distance from the rotor against the mechanical stop. The apron is preferably arranged to move away from the rotor, if the forces generated within the crushing chamber exceed a predetermined threshold and is preferably free to return to its suspended position against the mechanical stop after dissipation of the excess forces.

Hence, in the event of uncrushable feed material being present within the crushing chamber, the forces generated within the crushing chamber may exceed the pre-load, causing the apron to pivot away from the rotor, in which case the apron is no longer suspended against the mechanical stop. However, after removal of the uncrushable material, the apron is free to pivot and return to its normal working position suspended against the mechanical stop.

Impact crushers in accordance with the invention are considered to provide significant improvements over known impact crushers, not least since the mechanical stop facilitates simple re-setting of the working position of the apron, e.g. independently of the pre-loading arrangement. Suspension of the apron against the mechanical stop also provides a safety mechanism for preventing the apron from being driven into the rotor in the event of a failure in the pre-loading arrangement. Simple adjustment of the distance between the rotor and the apron may also be achieved, by using preloading arrangement to support the mass of the apron, to then enable repositioning of the mechanical stop and thereby alter the normal suspended position of the apron relative to the rotor.

In preferred embodiments, the first arrangement includes a pressure cylinder for applying said pre-load to the apron. For example, the apron may be arranged in communication with the output shaft of an hydraulic or pneumatic cylinder, wherein the cylinder can be pressurized to provide a pre-load for opposing forces generated within the chamber. It is preferred if the pressure cylinder forms part of a pressure circuit including a relief valve configured to enable the apron to move away from the rotor in a controlled manner if the forces generated within the crushing chamber exceed a predetermined threshold.

The use of a pre-load, especially an hydraulic or pneumatic pre-load, is advantageous in reducing the effects of wear and fretting associated with micro movements of the components which hold the apron in its normal working position during crushing, and so improves the overall reliability of the crusher.

In another embodiment, the first arrangement includes a linear motor in communication with the apron, in order to provide said pre-load. Of course, other suitable pre-loading arrangements may be implemented in other embodiments. In each case, it is preferred if the apron is able to move away from the rotor when the forces within the chamber exceed a predetermined threshold.

In preferred embodiments, the apron is coupled to a suspension member which cooperates with the mechanical stop to set the normal working position of the apron within the crushing chamber. The relative position of the stop is preferably adjustable, so that the spacing of the apron from the rotor can be varied, as desired.

In particularly preferred embodiments, the crusher includes a suspension member which extends through a wall of the crushing chamber, the lower end of the suspension member is coupled to the apron, preferably via a pivotable connection, and an upper region of the suspension member cooperates with a mechanical stop, in order to limit the degree of extension of the suspension member within the crushing chamber. The degree of extension of the suspension member within the chamber controls the spacing between the apron and the rotor under normal operating conditions, i.e. when the forces generated within the chamber during operation of the rotor do not exceed the pre-load on the apron. Preferably, the relative position of the stop is adjustable, so that the set spacing of the apron from the rotor can be varied, as desired.

In preferred embodiments, an upper end of the suspension member is threadingly engaged in a sleeve member which includes a stop intended to abut another stop surface on the crusher, e.g. a wall of the crushing chamber, so as to limit the extension of the suspension member within the chamber. The sleeve may be rotated to increase or reduce the extension of the suspension member from the sleeve. In preferred embodiments, the sleeve member is located externally of the crushing chamber for cooperation with an external stop surface, e.g. an outer wall or a plate mounted on an external part of the crusher.

The apron is preferably suspended in the chamber under gravity against the mechanical stop.

In preferred embodiments, adjustment of the distance between the rotor and the apron is achieved by supporting the mass of the apron using the pre-loading arrangement, so that the relative position of the stop members can be readily adjusted. In particularly preferred embodiments, this means removing the load from the suspension member to enable easy rotation of the sleeve relative to the shaft. Once the desired position of the apron has been set, the load can be transferred from the pre-loading arrangement to the suspension arrangement.

According to a further aspect of the invention, there is provided a method of processing material in an impact crusher, wherein the impact crusher includes a crushing chamber, a rotor mounted in the crushing chamber, and an apron having an impact surface, said apron being movably positioned within the chamber, the method including the steps of pre-loading the apron to oppose forces generated within the crushing chamber, wherein the apron is arranged to move away from the rotor in the event that the forces generated within the chamber exceed a predetermined threshold, e.g. in the event of uncrushable material being present in the chamber.

In a preferred method, the apron is suspended within the chamber against a mechanical stop during normal use, and the apron is automatically returned to its suspended position after the removal of uncrushable material from the chamber.

According to another aspect of the invention, there is provided an impact crusher including a crushing chamber, a rotor mounted in the crushing chamber, and an apron having an impact surface, wherein the apron is movably positioned within the chamber, and is pre-loaded to oppose forces generated within the crushing chamber.

According to another aspect of the invention, there is provided an impact crusher including a crushing chamber, a rotor mounted in the crushing chamber, and an apron having an impact surface, wherein the apron is movably positioned within the chamber and is arranged in communication with a pressure cylinder for pre-loading the apron to oppose forces generated within the crushing chamber in use; wherein the pressure cylinder forms part of a pressure circuit having a relief setting for enabling the apron to move away from the rotor when the forces generated within the chamber exceed a predetermined level; and wherein a suspension member extends within the chamber and is coupled with the apron for suspending the apron within the chamber, wherein the suspension member cooperates with a mechanical stop, for limiting the degree of extension of the suspension member within the chamber under normal operating conditions.

BRIEF DESCRIPTION OF THE DRAWINGS

Other aspects and preferred features of the invention will be readily apparent from the following description, made by way of example only, with respect to the accompanying Figures, in which.

DETAILED DESCRIPTION OF THE PREFERRED EMBODIMENTS

Figure 1:
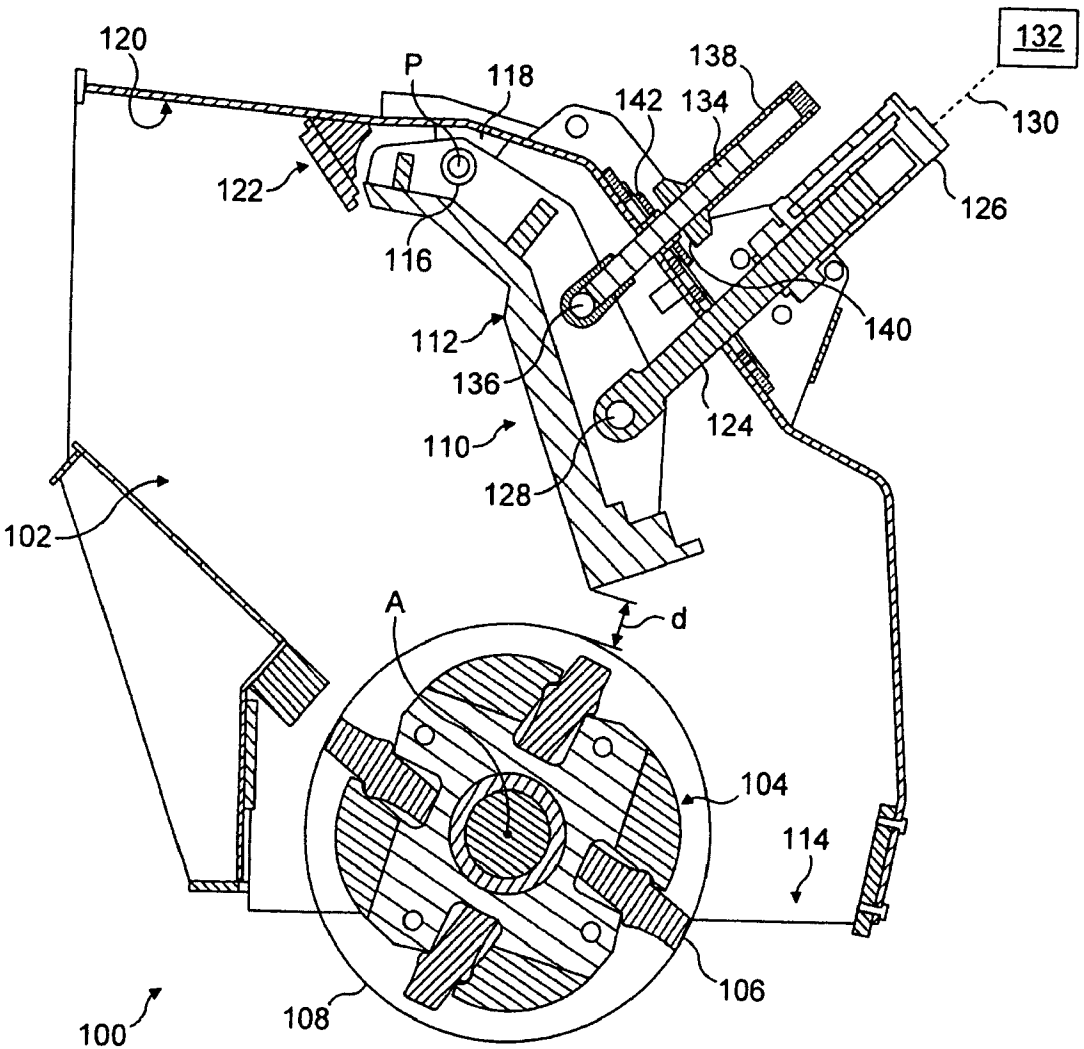
FIG. 1 is a schematic cross-section of an impact crusher according to a preferred embodiment of the invention.

Referring firstly to FIG. 1, an impact crusher is indicated generally at 100. The impact crusher 100 is of generally known type, in so far as it includes a crushing chamber 102 for processing material, such as waste building materials or quarried rock product and the like, a rotor 104 mounted for rotation about an axis A within the chamber 102, wherein the rotor 104 includes a plurality of arms, hereinafter referred to as blow bars 106, which extend in a generally radial direction relative to the axis of rotation A, which serve as impact devices, for striking material within the chamber 102 during operation of the rotor 104. A circle 108 has been included in FIG. 1, to indicate the swept area of the rotor 104. Other configurations and/or forms rotor or impact device may be provided, as desired.

An impact apron 110 having an impact surface 112 is suspended within the chamber 102, such that the impact surface 112 is arranged at a desired distance 'd' from the swept area 108 of the rotor 104.

In this embodiment, the lower end of the crushing chamber 102 includes a discharge outlet 114 for the passage of comminuted material from the crushing chamber 102.

As described in more detail below, a pre-load is applied to the apron 110 in order to oppose forces generated in the crushing chamber 102 during operation of the rotor. In addition, the position of the apron 110 within the chamber 102 is adjustable, in order to increase or reduce the distance 'd' between the impact surface 112 and the rotor 104, and thereby control the maximum grade of material to be discharged from the crushing chamber 102.

In this embodiment, the apron 110 is pivotable about a fixed pivot point defining a pivot axis 'P'. More particularly, the upper end of the apron 110 is coupled to a bracket 118 extending from an internal wall 120 of the chamber 102 by a pivotal connection 116. Hence, the lower end of the apron 110 is effectively rotatable about the pivot point axis 'P'. A deflector 122 is provided adjacent the upper end of the apron 110, to prevent material from access to the rear side of the apron 110.

A double-acting pressure cylinder arrangement is mounted on the crusher 100, in communication with the apron 110. The pressure cylinder arrangement includes a piston 124 mounted for reciprocal movement in a cylinder 126. A distal end of the piston 124 extends into the chamber 102 and is coupled to the apron 110 by a pivotal connection 128, which is remote from the pivot axis 'P'. In normal use, an hydraulic pressure circuit, indicated generally by dotted lines 130, communicates with the piston 124, to apply a pre-load to the apron 110. As will be described below, the pressure circuit 130 includes a relief valve indicated at 132.

The crusher 100 also includes a mechanical arrangement for control and adjustment of the operating distance 'd' between the apron 110 and rotor 104. In this embodiment, the mechanical arrangement includes a threaded screw shaft 134, which extends into the chamber 102 and is coupled to the apron 110 via a pivotal connection 136. The shaft 134 serves as a suspension member for the apron 110. In this embodiment, the connection 136 is arranged between the fixed pivot point 116 and the pivotal connection 128 of the cylinder arrangement.

A sleeve 138 is threadingly engaged on an upper portion of the shaft 134, external to the chamber 102. A portion of the sleeve 138 (in this embodiment, the lower end of the sleeve 138) acts as a stop 140, which is intended to abut against an opposing stop 142, e.g. a plate or other part of the crusher 100, for limiting the extension of the shaft 134 within the chamber 102. Relative rotation between the sleeve 138 and the shaft 134 results in a respective increase or decrease in the extension of the screw shaft 134 from the sleeve 138, and so brings about a change in the distance 'd' between the apron 110 and the swept area 108 of the rotor 104.

In normal use, the apron 110 is arranged at a distance 'd' from the swept area 108 of the rotor 104, according to the extension of the shaft 134 from the sleeve 138 and the abutment of the stops 140, 142. Moreover, a pre-load, e.g. 100 bar, is applied to the apron 110, via the pressure circuit 130 and piston 124, for the purpose of resisting forces generated during a crushing operation, i.e. as the rotor 104 is rotated at high speed against feed material within the crushing chamber 102. The pressure circuit 130 is continuously re-pressurized, to compensate for any leakage in the circuit 130.

The forces generated within the crushing chamber 102 during normal comminution are balanced against the hydraulic relief valve 132. However, the relief valve 132 is configured to permit retraction of the piston 124 if the forces in the crushing chamber 102 exceed a predetermined threshold, e.g. 120 bar, indicative of oversize uncrushable material being present in the crushing chamber 102. This enables the apron 110 to pivot about point 116 and so increase in the distance 'd' between the apron 110 and the swept area 108 of the rotor 104, e.g. until the uncrushable material has passed through the discharge outlet 114. During this movement of the apron 110, the shaft 134 is able to move rearwardly such that the stops 140, 142 may disengage.

Of course, the size of the uncrushable material may exceed the maximum rearward travel possible for the apron 110, in which case an operator may be required to manually clear the blockage. However, in most cases, the uncrushable material will pass through the discharge outlet 114 without manual intervention, so that the apron 110 is free to its normal working position against the mechanical stop, with the pressure circuit 130 re-pressurized to its original pre-loaded state.

In order to adjust the distance 'd' between the apron 110 and the swept area 108 of the rotor 104, the pressure circuit 130 can be programmed to support the mass of the apron 110 via the piston 124. This enables the screw shaft 134 and/or sleeve 138 to be rotated with minimal effort. Once the desired extension of the shaft 134 has been set, the load can be transferred back from the pressure circuit 130 to the mechanical suspension arrangement.

It will be understood that the apron 110 is suspended within the crushing chamber 102 against a mechanical stop, and is pre-loaded (above zero) to oppose forces generated within the chamber during normal use, with a relief arrangement provided to permit the apron 110 to move away from the rotor in the event of uncrushable being present in the chamber 102.

By pre-loading the apron 110, the components used to mount the apron within the chamber 102 are less susceptible to vibrations and associated wear. The crusher is 12 further advantageous in that it provides for automatic re-setting of the normal working position of the apron, independently of the pre-loading arrangement, after the removal of uncrushable material.

Although the illustrated embodiments include a pressure cylinder arrangement for preloading the apron, alternative pre-loading mechanisms may be incorporated, e.g. a motor type linear actuator. In each case, it is preferred that the apron is capable of movement away from the rotor if forces generated within the chamber during crushing exceed a predetermined threshold.

The mechanical screw arrangement of the illustrated embodiment allows for convenient control and adjustment of the distance between the apron and the swept area of the rotor. However, other mechanisms may be incorporated, e.g. a strut, shaft or rod of fixed length which is coupled to the apron and is arranged for cooperation with an adjustable stop member, for limiting the degree of extension of the strut within the chamber, whilst permitting retraction of the apron.

Figure 2:
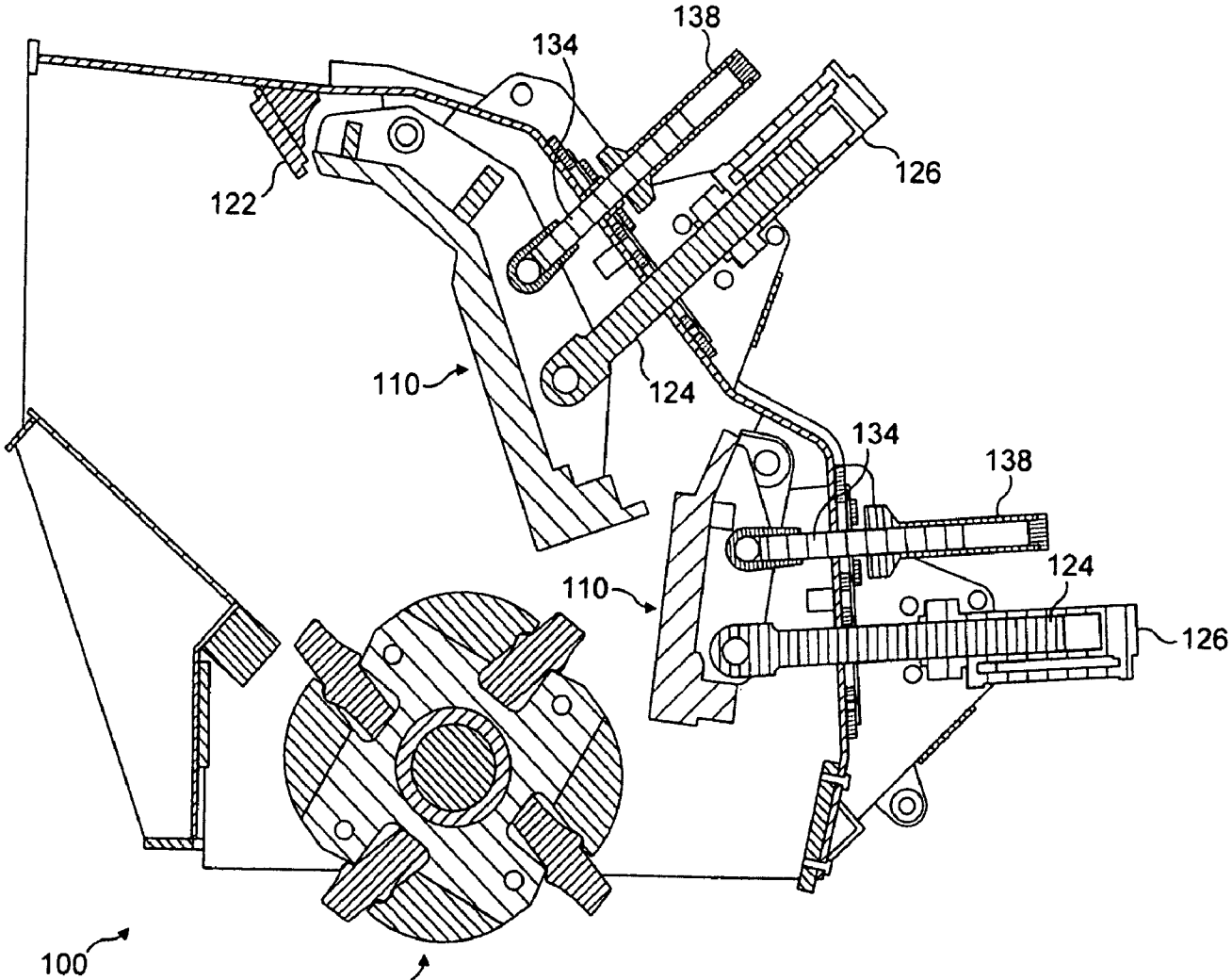
FIG. 2 is a schematic cross-section of an impact crusher according to another preferred embodiment of the invention.

One or more additional aprons 110 may be included, for example as shown in FIG. 2, wherein each apron 110 is preferably adjustably suspended within the chamber 102 in the same or substantially similar manner to that described above.

The invention claimed is:

1. An impact crusher including:

a crushing chamber;

a rotor mounted in the crushing chamber;

an apron movably mounted within the chamber and having an impact surface;

a suspension member extending into said chamber and coupled with said apron for suspending the apron within the chamber;

a mechanical stop engaging with said suspension member to limit the degree of extension of the suspension member within the chamber under normal operating conditions and to provide an initial spacing between said apron and said rotor;

a pressure cylinder engaging said apron to resist movement of said apron away from said rotor; and a pressure relief valve hydraulically connected with said pressure cylinder to relieve pressure within said cylinder upon a predetermined pressure being produced by forces against said apron to permit said apron to be moved away from said rotor.

2. An impact crusher according to claim 1 wherein the pressure cylinder forms part of a pressure circuit including a relief valve configured to enable the apron to move away from the rotor in a controlled manner if the forces generated within the crushing chamber exceed a predetermined threshold.

3. An impact crusher according to claim 1 wherein the position of the stop is adjustable, so that the spacing of the apron from the rotor can be varied, as desired.

4. An impact crusher according to claim 1 wherein said stop comprises an upper end of the suspension member being threadingly engaged in a sleeve member which includes a stop surface intended to abut another stop surface on the crusher, so as to limit the extension of the suspension member within the chamber.

5. An impact crusher according to claim 4 wherein the sleeve member is located externally of the crushing chamber for cooperation with an external stop surface.

6. The impact crusher as defined in claim 1 and including means to adjust the pressure within said pressure cylinder to adjust the pressure resisting movement of said apron away from said rotor whereby to preload the apron to oppose forces generated within the crushing chamber during normal use.

7. An impact crusher according to claim 1 and further comprising:

said pressure cylinder includes an output shaft; and said output shaft being connected with said apron whereby pressurizing the pressure cylinder provides a pre-load to said apron to oppose forces generated within the chamber.

8. An impact crusher according to claim 1 wherein the crusher further comprises:

said suspension member extending through a wall of the crushing chamber;

a pivotable connection connecting the lower end of the suspension member to the apron;

an upper region of the suspension member being connected with said stop to limit the degree of extension of the suspension member within the crushing chamber.

* * * * *